US010002702B2

(12) United States Patent
Rimmer

(10) Patent No.: US 10,002,702 B2
(45) Date of Patent: Jun. 19, 2018

(54) COUPLER FOR USE IN A POWER DISTRIBUTION SYSTEM

(71) Applicant: Isotera Ltd., St. Neots, Cambridgeshire (GB)

(72) Inventor: Philip John Rimmer, Greater London (GB)

(73) Assignee: GREENGAGE LIGHTING LIMITED, Manchester (GB)

( * ) Notice: Subject to any disclaimer, the term of this patent is extended or adjusted under 35 U.S.C. 154(b) by 278 days.

(21) Appl. No.: 14/362,816

(22) PCT Filed: Dec. 6, 2012

(86) PCT No.: PCT/GB2012/000891
§ 371 (c)(1),
(2) Date: Jun. 4, 2014

(87) PCT Pub. No.: WO2013/083949
PCT Pub. Date: Jun. 13, 2013

(65) Prior Publication Data

US 2014/0333400 A1 Nov. 13, 2014

(30) Foreign Application Priority Data

Dec. 6, 2011 (GB) ..... 1120955.8

(51) Int. Cl.

| | |
|---|---|
| ***H01F 27/24*** | (2006.01) |
| ***H01F 38/20*** | (2006.01) |
| ***H01F 17/06*** | (2006.01) |
| ***H01F 3/08*** | (2006.01) |
| ***H01F 27/26*** | (2006.01) |
| *H01F 29/10* | (2006.01) |

(52) U.S. Cl.
CPC ..... *H01F 27/24* (2013.01); *H01F 3/08* (2013.01); *H01F 27/266* (2013.01); *H01F 29/10* (2013.01)

(58) Field of Classification Search
None
See application file for complete search history.

(56) References Cited

U.S. PATENT DOCUMENTS

| | | | |
|---|---|---|---|
| 3,708,749 | A | 1/1973 | Bateman et al. |
| 4,011,505 | A | 3/1977 | Spalding |
| 6,211,767 | B1 | 4/2001 | Jitaru |
| 6,794,769 | B2 | 9/2004 | Black |

(Continued)

FOREIGN PATENT DOCUMENTS

| | | | |
|---|---|---|---|
| CN | 201465697 | U | 5/2010 |
| CN | 101996740 | A | 3/2011 |

(Continued)

OTHER PUBLICATIONS

G.G. Orenchak, "Measuring Soft Ferrite Core Properties;" IEEE Electrical Manufacturing & Coil Winding Conference; 1995; pp. 497-500.

*Primary Examiner* — Ronald Hinson
(74) *Attorney, Agent, or Firm* — Ware, Fressola, Maguire & Barber LLP

(57) ABSTRACT

A novel coupler, coupler housing and ferrite core and associated elements and concepts thereof and therefor for use in particular with an Inductive Power Transfer or Distributed Power System.

3 Claims, 18 Drawing Sheets

(56) References Cited

U.S. PATENT DOCUMENTS

Figure 1:
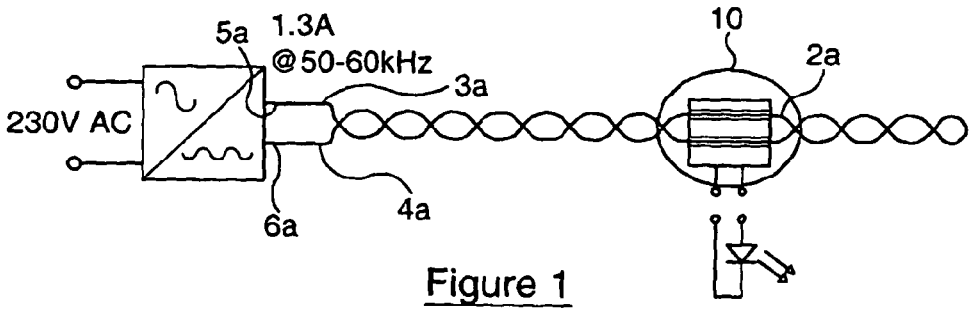

| | | | | |
|---|---|---|---|---|
| 7,825,544 | B2 * | 11/2010 | Jansen | A61C 1/0015 307/104 |
| 2001/0028290 | A1 * | 10/2001 | Iwasaki | B06B 1/04 335/78 |
| 2002/0175797 | A1 * | 11/2002 | Black | H01F 27/266 336/182 |

FOREIGN PATENT DOCUMENTS

| | | | |
|---|---|---|---|
| DE | 0576994 | A | 5/1933 |
| DE | 20 12 583 | A1 | 9/1971 |
| EP | 0587923 | A1 | 3/1994 |
| GB | 1191756 | A | 5/1970 |
| JP | 09149502 | A | 6/1997 |
| JP | 2000150273 | A | 5/2000 |
| JP | 2006332475 | A | 12/2006 |
| JP | 2011181572 | A | 9/2011 |
| WO | 99/19890 | A1 | 4/1999 |
| WO | 2009/053534 | A1 | 4/2009 |
| WO | 2010/106375 | A2 | 9/2010 |

* cited by examiner

Auxiliary transformer

COUPLER FOR USE IN A POWER DISTRIBUTION SYSTEM

CROSS REFERENCE TO RELATED APPLICATIONS

This application is the U.S. National Stage of International Application Number PCT/GB2012/000891 filed on Dec. 6, 2012 which in turn claims priority under 35 USC § 119 to United Kingdom patent application 1120955.8 filed on Dec. 6, 2011. Both applications are hereby incorporated by reference in their entirety.

This invention relates to a coupler for use in a power distribution system and more particularly for use in a system for distributing high frequency AC power. The coupler is used as a means for transferring power from a power supply to a load in an inductive manner.

A power distribution system is disclosed in WO2010/106375. The coupler disclosed in the present application is ideally suited for use in that power distribution system.

A coupler is disclosed in WO2010/106375 for use with the power distribution system therein. However, the coupler embodiment shown in WO2010/106375 is limited in terms of its efficiency and ease of installation on to the power distribution system. The present invention discloses a significantly improved coupler that has various optimised characteristics to improve efficiency and, particularly, ease of installation. It also addresses other issues such as the requirement to keep the mating surfaces of a two-or-more part transformer clean so as to optimise power transfer capability.

It is desirable when distributing power as a high frequency AC current or voltage to limit the inductance of the HFAC circuit (which increases circuit voltages and aggravates good current control) and to minimise its ability to generate a large alternating magnetic field (H-field), a source of loss and interference. These are both achieved if the HFAC send and return paths are near identical. A twisted pair cable (known in the art) achieves this requirement, adds a continual rotation to its small magnetic field, thereby further reducing H-field by cancellation at a modest distance, and allows the wires to be readily separated for use.

Highly efficient and well regulated couplers at present are non-splittable transformer cores e.g. toroids, which can guarantee consistent and sufficient magnetic capabilities. These need to have the HFAC-bearing wire threaded through their centres. This is not consistent with rapid installation and maintenance. Removing a failed unit in a chain of such couplers is particularly egregious.

The power that can be transferred by a coupler, which employs only one or two turns of the HFAC cable as its primary, is proportional to the current in that cable. Couplers achieve good power transfer by using very high loop currents. These high currents aggravate all the previous mentioned failings of HFAC radiated loss and interference. It is an additional detriment to the system that current loops will have high static cable losses when operated at high currents. This is made the worse at high frequency when skin effect makes large diameter wires increasingly lossy in proportion to their cross sectional area. Lower currents on thinner wires represent a much better balance of cost and performance for the cabling.

The problems to be solved with the design of coupler transformer cores is to produce a split-able transformer core that can work with twisted pair cable and offer substantial power transfer with only moderate loop currents. Suitable geometries, materials and processes are needed to confer exceptional inductance and cross sectional area to achieve this performance and suitable measures managing contamination and the vagaries of repeated use taken to mitigate the conflicts with these necessary magnetic parameters.

Figure 2:
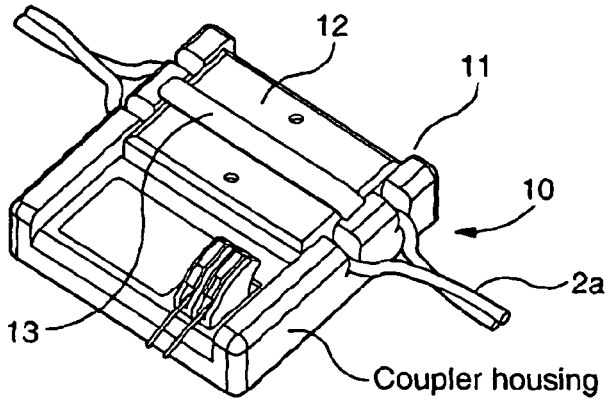

In order that the invention may be more readily understood, and so that further features thereof may be appreciated, embodiments of the invention will now be described, by way of example, with reference to the accompanying drawings in which:

FIG. 1 is a schematic diagram of a power distribution system;

FIG. 2 onwards show a coupler embodying the present invention and associated components thereof.

A power distribution system shown in FIG. 1 uses a twisted pair of elongate conductors 3A, 4A formed for a single loop of insulated wire which is folded in half and twisted to form the twisted pair 2A. The free ends 5A, 6A of the conductors 3A, 4A are positioned adjacent one another and connected to high frequency AC power source 7A.

The high frequency AC power source 7A preferably converts mains electricity at 110V or 240V AC at a frequency of approximately 50 Hz or 60 Hz or within the range 47 to 63 Hz to high frequency AC power at, but not limited to, approximately 50 kHz. The high frequency AC power source is current regulated or limited, preferably.

The high frequency AC power source preferably provides but is not limited to a voltage of between 150V and 1KV at an operating frequency of greater than 10 kHz. The operating frequency is preferably 10 kHz to 200 kHz but most preferably at a frequency within the range of 50 kHz or 60 kHz. The loop defined by the twisted pair 2A equates to a turn of a transformer coil which is connected to the high frequency AC power source 7A.

The power distribution system 1A incorporates a power tapping element 10, herein a "coupler", which comprises a ferrite core 12 in the form of a splittable ferrite element, which acts as a transformer. Aspects of the invention relate to the ferrite element, the coupler, and the coupler housing which may comprise other elements.

A coupler 10 embodying the present invention is shown in FIG. 2.

Figure 9:
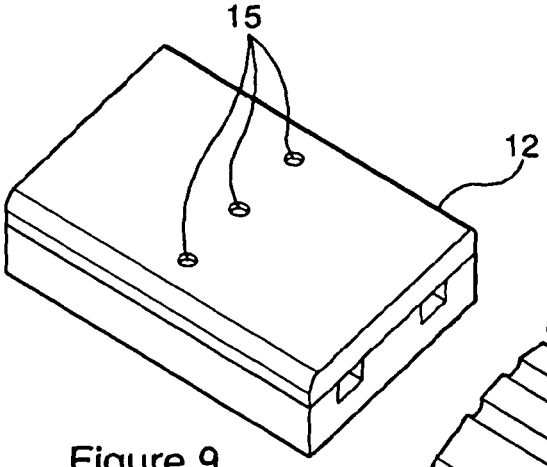
Figure 9A:
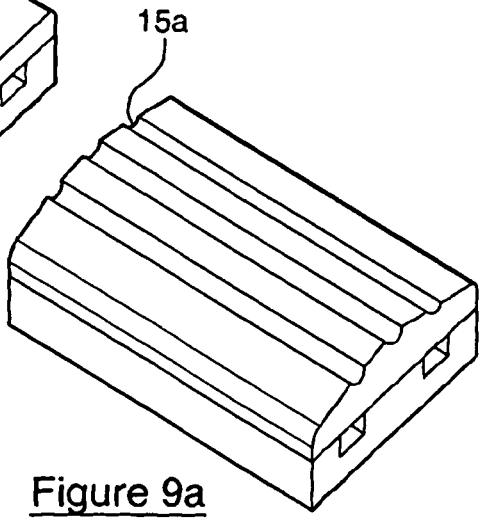

The coupler 10 comprises a housing formed with a recess 11 which accommodates a two-part ferrite core 12 for use as a transformer. The two-part ferrite core 12 incorporates a top half and a bottom half. The bottom half of the ferrite core 12 is preferably mounted to a metal base. The metal base is in thermal communication with the ferrite core 12 so that, in use, heat is conducted from the ferrite core 12 into the metal base. In some embodiments, a heatsink is attached to the metal base to further dissipate heat from the metal base. The optional metal base and heatsink therefore dissipate heat from the ferrite core 12 to enable the coupler to operate at a higher power level. A preferred embodiment of the two-part ferrite core is shown in FIG. 9.

The loop defined by the twisted pair 2A is a single turn of a transformer coil and the pair of wires are located in the ferrite core held in the recess of the coupler housing.

A clamping mechanism 13 sits over the two-part ferrite core and positively locates the core in the recess.

In one embodiment, the clamping mechanism is in the form of a sprung metal finger 13. In one embodiment the finger 13 is preferably configured as a sprung cantilevered finger free at one end and defining the top surface of the retaining element for keeping the core in the recess 11. Whilst the finger is shown as being cantilevered at one end, the finger 13 can also be held or secured at both ends to the coupler housing so as to provide a spring bridge located over the ferrite core, in position. Preferably, the finger 13 is secured at both ends to the coupler housing and the finger 13 is substantially u-shaped in cross section. The finger 13 is configured to be resiliently deformed as it is pressed against the top surface of the upper part of the splittable ferrite core 12.

In one embodiment the centre of the underside of the finger 13 carries a small protrusion, a rounded bump, depending into the recess 11. The bump in the finger locates in a rounded dimple 15 in an upper surface of the ferrite core 12 serving to locate the ferrite core accurately below the finger and pressing the two-part ferrite core together and also into the recess 11.

In a preferred embodiment, the underside of the finger 13 is an elongate u-shaped section that is provided instead of the above described protrusion or rounded bump. The elongate u-shaped section depends into an elongate channel 15*a* provided in the top surface of the two-part ferrite core 12. The elongate u-shaped section spreads the resilient force exerted by the finger 13 along the majority of the length of the top surface of the two-part ferrite core 12. Therefore, the elongate u-shaped region does not exert a force at an isolated point of the ferrite core 12. The u-shaped section is thus less likely to damage the ferrite core 12 than other arrangements where a force is applied to a ferrite core at a single point. The elongate u-shaped section also aligns longitudinally with an elongate channel in the top surface of the ferrite core 12 to retain the ferrite core 12 in alignment with the finger 13 and the housing. The u-shaped section of the finger 13 thus improves rotational stability of the top half of the two-part ferrite core 12.

The two-parts of the ferrite core 12 are positively held together by the force exerted by the finger spring 13. In operation, including when operated at high frequencies, ferrites can exhibit magnetostriction which changes, sometimes rapidly, the shape of the ferrite resulting in vibration and in some cases audible noise particularly when being operated or when operation is interrupted at lower frequencies, or lower frequencies in the high frequency range such as when dimming lighting components connected to the coupler output.

The finger spring 13 serves to clamp the two parts of the ferrite core together to prevent such noise and/or vibration.

Figure 22:
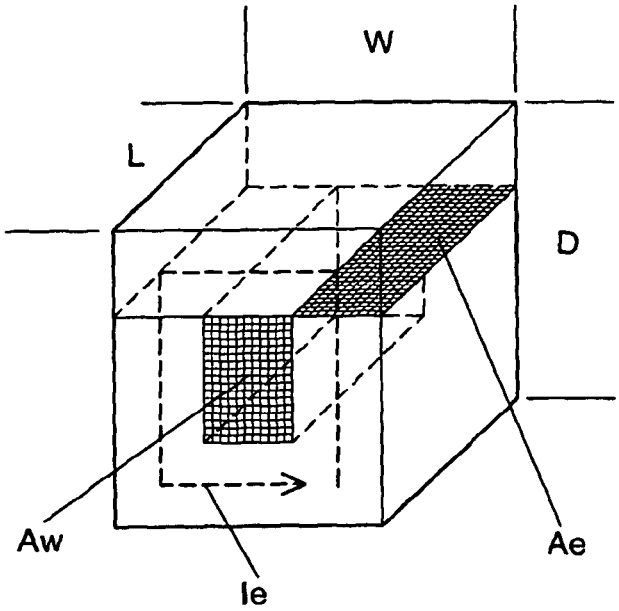

The structure of the ferrite core 12 is a two-part construction, preferably comprising an E-core formed with two channels which are preferably parallel to receive the primary winding wires 2A and also the secondary windings of the coupler. The E-core is capped with an I-core which sits exactly on the E-core to close the channels and provide flat smooth mating surfaces between the I-core and the upstanding side walls of the E-core. In an alternative embodiment the ferrite parts may be in the form of a U-core and an I-core, as illustrated in FIG. 22, which utilise a single length, or one wire only of a twisted pair, as a primary winding. Such an alternative embodiment is generally prone to creating more 'noise' in the distributed power system than the E-core and I-core embodiment, which utilises both the 'send' and 'return' paths of the twisted pair wire in adjacent locations along the length of the ferrite core. Such a preferred E-core and I-core arrangement provides for a more efficient, less noisy and balanced load on the system. The U-core and I-core arrangement is still universally acceptable for use at very, low power transfer rates, however, in the range of from zero up to 5 w, but may be higher where the power distribution cable is comparatively short. However, a short cable potentially detracts from the general usefulness of the overall power distribution system.

It is important that the mating surfaces of the two-cores are flat and smooth to maximise efficiency and power transfer capability. In some embodiments, the top surface of the ferrite core 12 incorporates elongate channels that have side edges that are shaped to facilitate sliding of a projection on the finger spring 13 into and out from the channels. For instance, in one embodiment the or each channel has two elongate side edges with one side edge at a shallower angle than the other side edge relative to the planar top surface of the ferrite core 12.

Figure 32:
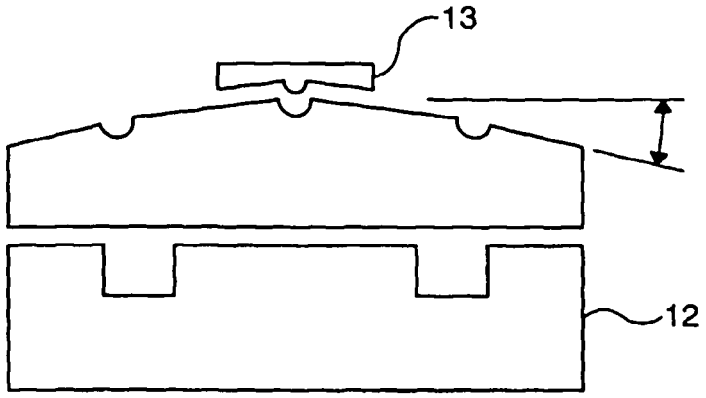

In further embodiments, the top surface of the ferrite core 12 is not planar. In these embodiments, the top surface of the ferrite core 12 incorporates raised and lowered regions. In one embodiment, the regions of the top surface that are provided with elongate channels are raised and the surrounding regions are lowered. The portions of the top surface between the raised and lowered regions are inclined so that a projection on the finger spring 13 can slide between the raised and lowered regions and into the channels. The raised regions deform the finger spring 13 to a greater extent than the lowered regions so that the finger spring 13 exerts a larger force on the ferrite core 12 when the projection is resting on a raised region as compared with when the projection is resting on a lowered region. As will become clear from the description below, the ferrite core 12 is configured to be slidable relative to the finger spring 13. The variable force exerted by the finger spring 13 on the top surface of the ferrite core 12 as a result of the raised and lowered portions is such that the finger spring 13 exerts a large force on the top surface when the top half of the ferrite core 12 is aligned with the bottom half of the ferrite core 12. The finger spring 13 exerts a lower force on the top surface when the top half of the finger spring 13 is slid out of alignment with the bottom half to facilitate sliding of the top half relative to the bottom half. This arrangement is illustrated by exaggerative example in FIG. 32.

The dimple or elongate channel formed on the upper surface of the I-core should be as flat, shallow and smooth as possible to maximise efficiency of the core.

Figure 10:
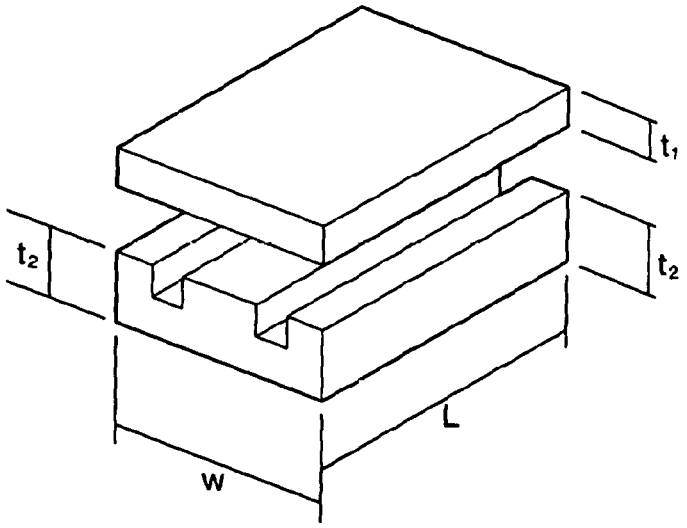

An example core is shown in FIG. 9. The geometry and parameters of the two-part core 12 are shown in FIG. 10.

Figure 12:
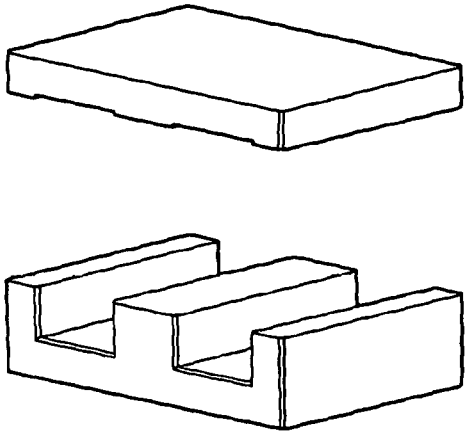
Figure 13:
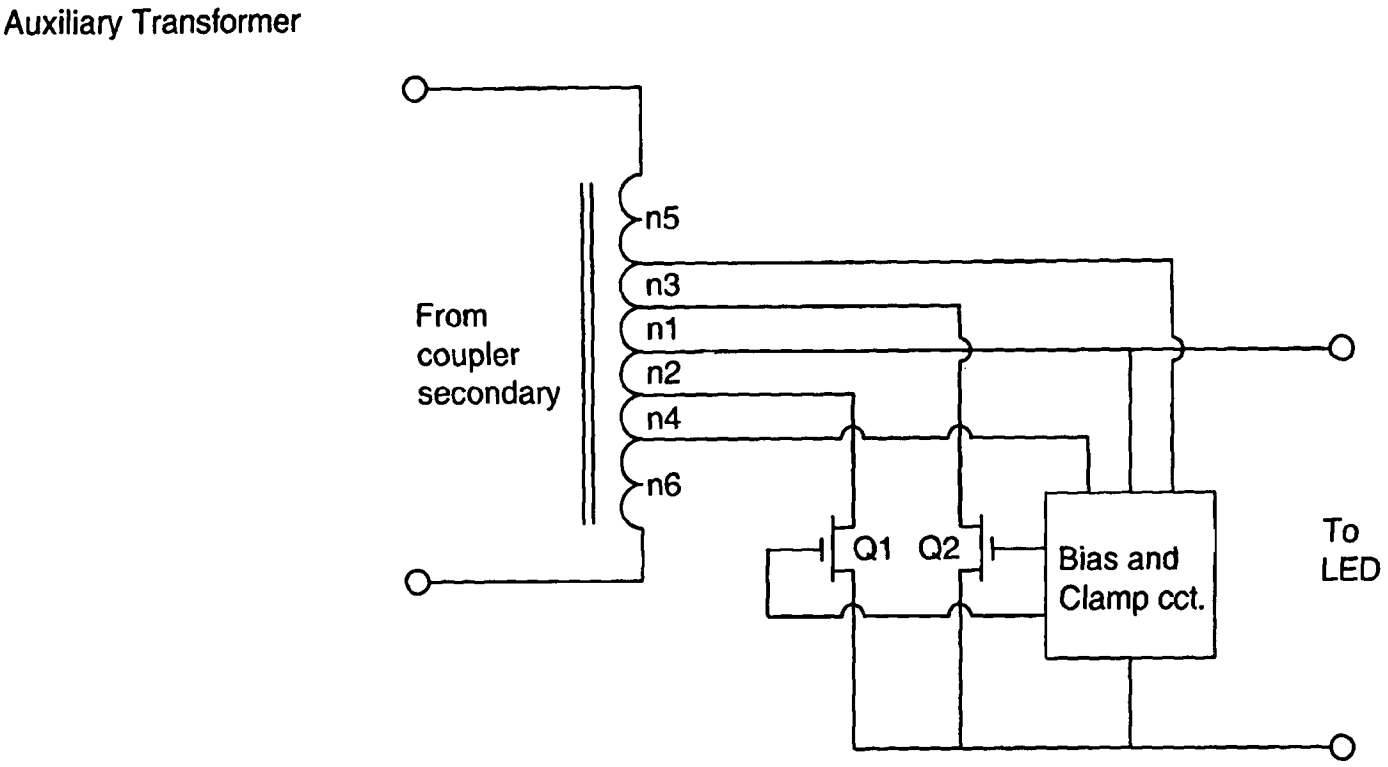

An auxiliary transformer is provided optionally if components in the coupler require a customised supply. An example of the core for an auxiliary transformer is shown In FIG. 12 and the manner in which the auxiliary transformer is connected into the coupler wiring is shown in FIG. 13.

Figure 5:
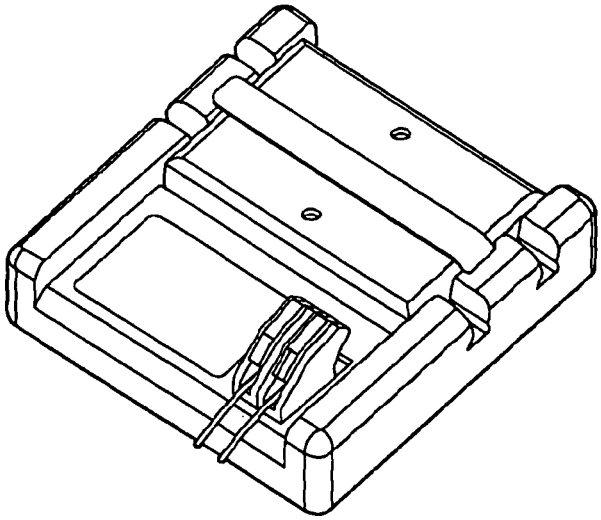

FIG. 5 shows the core 12 located in the recess 11 without the wires 2A comprising the primary winding for the main transformer/coupler.

Figure 7:
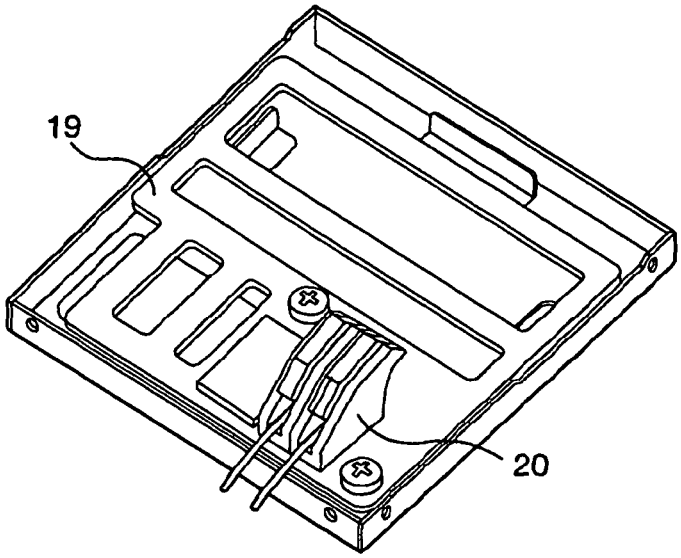

FIG. 7 shows a PCB 19 seated in the base of the coupler housing. A pair of universal clamp connectors 20 may be attached to the PCB so as to receive, without the use of tools or skilled fitting, any form of DC wire such as follicle wire or stranded wire. Other types of connective fitting may be attached to the PCB in order that power may ultimately be supplied to LEDs or other luminaires or lighting equipment.

Figure 6:
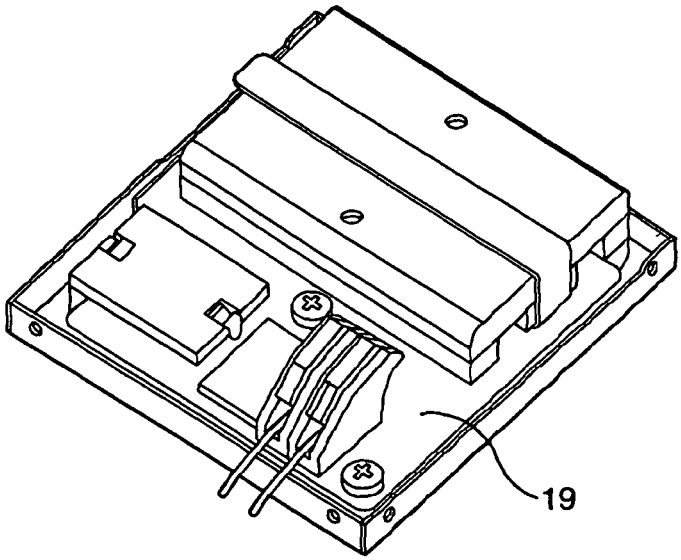

The PCB carries the secondary winding of the main transformer/coupler along the pair of elongate PCB rails Which sit in the base of the E-core channels. The PCB optionally also carries another winding for use with an auxiliary transformer having a core such as the one illustrated in FIG. 12 which may be used with other components carried on the PCB as illustrated in FIG. 6. Other means may be provided for carrying or connecting to the or a main secondary winding and the or an auxiliary secondary winding.

FIG. 6 shows the E-core of the main transformer located under the secondary windings sitting in the E-core channels but does not show the wires 2A. FIG. 6 does show the I-core located and clamped into place on top of the E-core by the finger spring 13.

Figure 14:
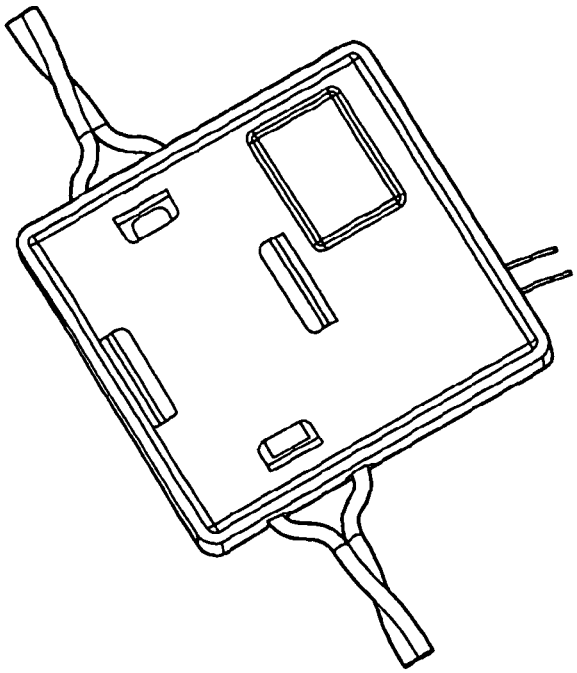

The coupler comes with the E-core ready mounted and secured in the coupler housing to the coupler base preferably by both mechanical means and adhesive bonding. The coupler base is preferably of metal so that the coupler base dissipates heat from the ferrite core 12. Adhesive bonding can be provided by a double-sided transfer tape from 3M™ such as F9460PC on the underside of the E-core fastening and accurately locating with mechanical guides the E-core to the base of the coupler housing. Referring to FIG. 7, slots in the coupler housing base are provided which can be used to feed the tape through thereby fixing the tape to the base by adhesive and also by mechanically deforming the tabs onto the tape. The slots are also shown in FIG. 14.

A further embodiment of the coupler as shown in FIG. 6 uses an I-core with three spaced apart accurately located dimples in the upper surface, as shown in FIG. 9, in sliding contact with the finger spring 13.

Figure 8:
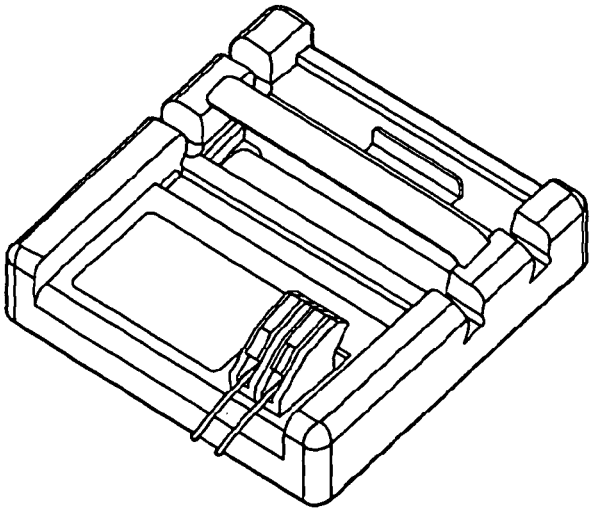
Figure 15:
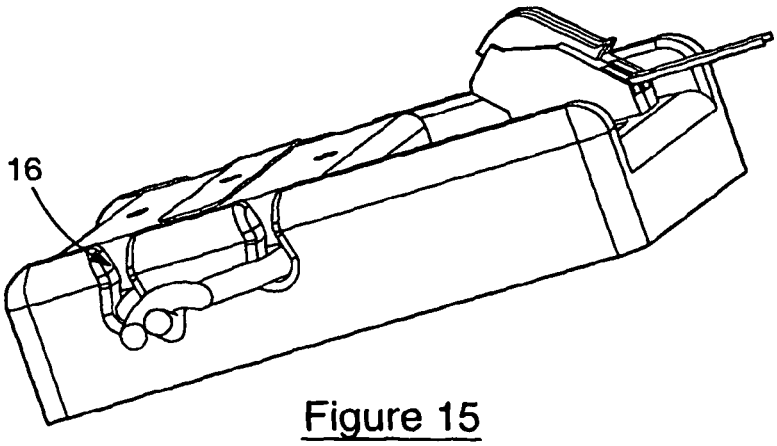
Figure 16:
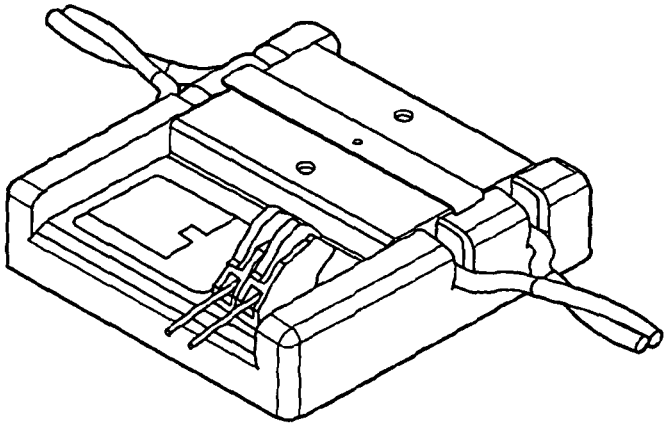
Figure 17:
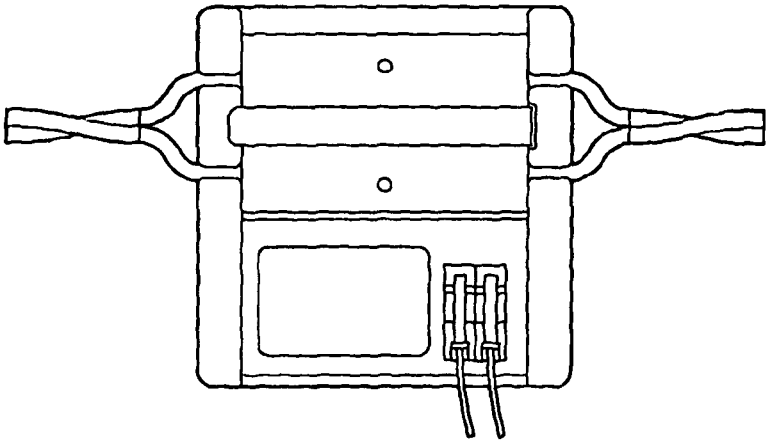
Figure 18:
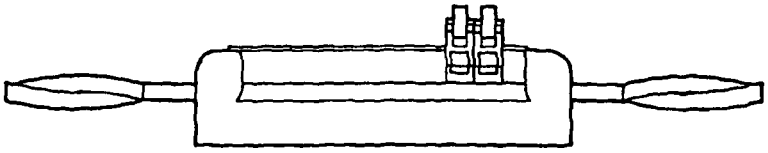
Figure 19:
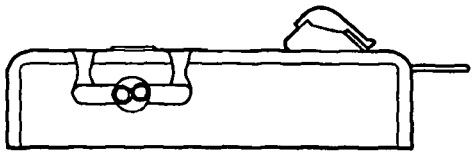
Figure 33:
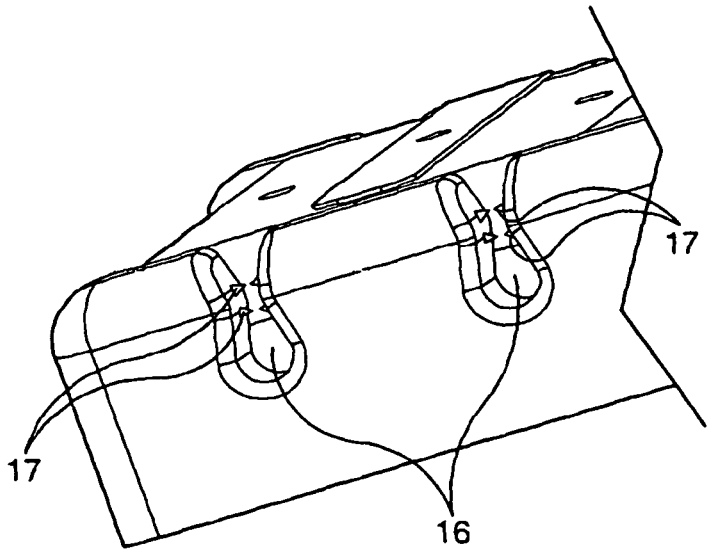

The coupler housing is provided with recesses 16 that are aligned with the channels in the ferrite core 12. Such an embodiment is shown in FIG. 8. The recesses 16 preferably each incorporate at least one projection 17 which contacts and retains a wire that is inserted into the recess. In one embodiment, the or each projection is a tooth or barb 17 that allows the wire to be pulled in one direction through the recess but not in the other direction. In a preferred embodiment each recess incorporates multiple projections in the form of angled teeth or barbs. In these embodiments, the projections retain the coupler in position on the wires 2A. The projections facilitate mounting of the coupler to the wires 2A by allowing a user to position the wires 2A in the recesses at one end of the coupler and then for the user to pull the wires 2A taut before inserting the wires 2A into the recesses at the other end of the coupler. The user can therefore pull the wires 2A taut so that the wires 2A sit straight within the channels in the ferrite core 12. The projection then hold the wires 2A in tension and minimise the chance of the wires 2A from being trapped between the two halves of the ferrite core 12 as the two halves are moved relative to one another. Detail of such an embodiment is shown in FIG. 33. The embodiment further shows that the recesses are 'necked' so that insertion of a wire requires a certain effort to overcome the resistance of the neck to having the wire pushed through the neck and into the recess (for a given wire diameter), after which a certain amount of mechanical restraint retains the wire in the recess. The aforementioned projections 17 add to this mechanical restraint, where present. The recesses can be provided as shown without projections, optionally, as otherwise discussed herein and shown in FIG. 15.

Figure 34:
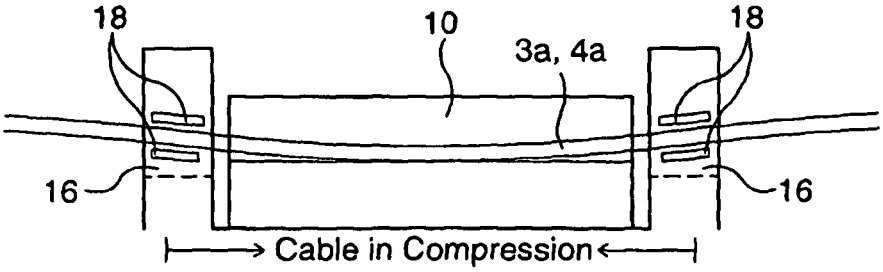

Conveniently, the retaining features 18 of the insertion channels/recesses 16 (necking, teeth/barbs, or alternatives such as ridging 18 or any combination of these features), mean that there is a beneficial assistance provided to the user when installing a wire into a channel of the E-core. The fact that the length of wire is positively retained at both of its 'ends' (in relation to its length within the channel) means that where the wire is sufficiently stout or stiff, it may be placed in the channel under compression. This is illustrated in FIG. 34. Not only does this mean the wire is positively retained in the channel, it is pressed into the channel so as to fit snugly and closely to the channel, and also is kept out of the path of the sliding/wiping motion of the I-core during the rest of the installation process.

An aspect of the invention as presented here is found in the particular dimensional parameters of the ferrite core and the advantages presented by these particular parameters. Cores with parameters in similar ranges as presented here may exist in the prior art, but the use of such prior art cores is solely in the field of filtering, by inductance, the conducted emissions of cables. As such, they are designed to produce higher losses than those desired in the current invention. In contrast, the current invention preferably uses low loss power grade ferrite as the core material. The use of a core with such parameters as a transformer as in the current invention, where primary and secondary windings are present, is both novel and inventive. The related inventive concept of a splittable ferrite core wherein a single primary coil is represented by a single length of wire from a twisted pair through each gap in the legs of an E-core requires a core geometry with a high inductance per turn. This is because a transformer with few inductance windings has a peak voltage limited by the available inductance prior to flux saturation of the core. Therefore in order to transfer as much power as possible, up to the flux saturation limit, whilst maintaining good load regulation (i.e.: a uniform ratio of output to input current over a wide load range), inductance must be made as large as possible whilst mitigating the undesirable effects of such a high inductance.

Inductance is nominally neutralised by shunting with a capacitor, making it resonant at the operating frequency. However, at very low inductances, problems occur. A resonant circuit with very low inductance and high compensating capacitance will have high circulating current, resulting in high ohmic losses in the resonant components and their wiring. Further, such a combination, if implemented with the lowest loss components in mitigation will then manifest a high Q (quality factor), resulting in a high sensitivity of output due to component or frequency tolerances at the input, which is undesirable in the present system. Such losses and tolerance issues make low inductances unacceptable from the viewpoint of efficiency, cost or stability. Accordingly, a ferrite core with high inductance even with low turns allows for an efficient, cost effective and reliable neutralisation to be applied—the circuit becomes low Q and thus tolerant of frequency and component variation, with low circulating current and low losses. This gives a good stable coupling that is also tolerant of temperature variation.

It is also desirable to minimise the volume of the core so as to minimise losses due to magnetic flux. Core losses increase quickly with flux density (B), not atypically by more than the power of 2; for example, Pl (Power loss)=$K_2 \times B^{2.5}$. Flux density itself is inversely proportional to the number of turns N on a winding and the cross-sectional area (Ae) of the magnetic path ($B=K_2 \times V/(N \times Ae)$. Hence, in a power distribution system environment such as that in which the present invention preferably forms a part, wherein the number of (primary) turns N is 1, as opposed to a larger number of turns as is more usually the case with transformers, a reduction in Flux density is obtainable by increasing the cross-sectional area Ae of the magnetic path.

It is also generally desirable from a cost perspective, as well as the requirements of convenience of the overall power distribution system, that the core be of small volume and thus of a small amount of material and weight.

In an aspect of the current invention, therefore, certain geometries are selected in order to obtain a particularly desirable configuration, in which the system is optimised. By way of illustration, FIG. 22 shows the key parameters of a generic rectangular two-part transformer core. Aw is the cross-sectional area of the winding, i.e. is the magnetic path length, and Ae is the cross-sectional area of the core. As can be seen in FIG. 10, the preferred embodiment of the ferrite core of the current invention is effectively a pair of such cores side-by-side.

A typical prior art core of approximately 100 g in weight, with a relative permittivity of 2,000, will have an inductance of around 5 microHenries per turn squared. For the use of the present invention in its preferred power distribution environment, where power is ultimately used to drive LEDs in a lighting system, it is preferable to have an inductance an order of magnitude higher. Inductance is proportional to Ae/Le. A typical prior art core will have Ae/Le of 0.002 meters. In a preferential embodiment of the current invention, Ae/Le is in the region of 0.01 meters, giving approximately 5 times the inductance per turn squared. Further increases in inductance over typical cores are obtained by using materials with higher permeability (relative permeability approximately 3,000), and by polishing the mating surfaces of the two ferrite core pieces, preferably by 'lapping'. In this way, an order of magnitude increase in inductance (per turn squared) over a typical prior art core can be achieved.

It will be appreciated that the expression Ae/Le is not dimensionless. In terms of a dimensionless ratio, it is possible to establish the ratio between the cross-sectional area of the magnetic path Ae compared to the cross-sectional area of the winding Aw. Typical prior art cores exhibit a core Ae/Aw ratio of approximately 1. In contrast, a core embodiment in accordance with the current invention may exhibit an Ae/Aw ratio in the region of 5.

Accordingly, embodiments of the invention use a ferrite core with an unusual shape. A preferred embodiment is shown in FIGS. 9 and 10. E-core and I-core ferrites are known but the depth (t1 plus t2) of such prior art E-core and I-core combinations is greater than the width of the combinations. This is because previous E-core and I-core combinations need to accommodate multiple primary windings. In examples of the present invention, only a single primary winding is accommodated in the channels of the E-core and the inventors have found that departing from the normal aspect ratio for an E-core and I-core combination and providing a combination which is wider than it is deep provides beneficial results. Accordingly, in accordance with embodiments of the invention, the E-core and the I-core combination has a width W which is greater than its depth (t1 plus t2), using the convention outlined in FIG. 10 of the accompanying drawings. In a specific example of the core shown in FIG. 10, the core has a 15 mm depth and a 34 mm width. Preferably, the depth (t1 plus t2) is approximately 17 mm, with t1=6 mm and t2=11 mm; width W is approximately 34 mm and the length L is approximately 50 mm. These particular parameters in approximately these ratios are found to exemplify the invention.

Adding a coupler embodying the present invention to a twisted wire pair such as shown in FIG. 1 is a simple process which can be undertaken by an unskilled user without the use of any tools.

The universal clamp connector is used to electrically and mechanically connect whatever mode is to be powered by the coupler from the power distribution system. In one example, the load is an LED light. In another embodiment the DC light is dimmable and a control plug is inserted to a control port carried on the coupler housing to electrically connect the control plug to components inside the coupler housing carried on the PCB. In this embodiment, the PCB preferably incorporates contacts positioned at one edge of the PCB to provide an edge connection for an external device that can be removably attached directly to the edge connection. In another embodiment, the control plug can be a data bus to handle data carried on the power distribution system.

Figure 3:
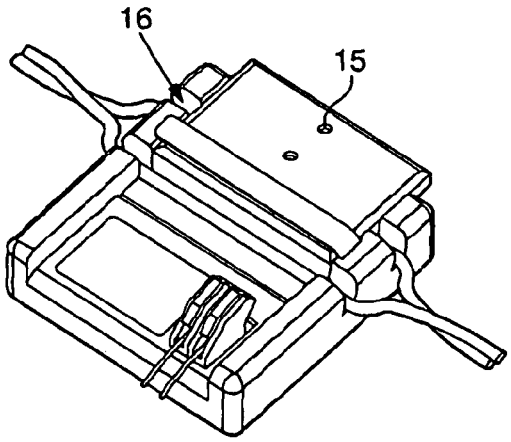
Figure 4:
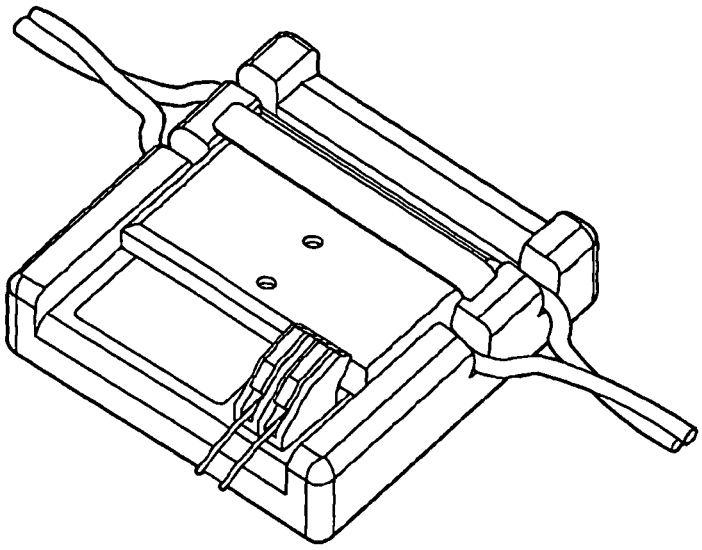

The sequence of connecting the wires 2A onto the coupler is as follows:

Starting from the positions at FIG. 5, slide the I-core out from under the finger spring overcoming the translation of force between the finger spring 13 protrusion sitting in the central dimple and sliding the I-core in a wiping motion over the mating surfaces of the E-core to sit one of the outer dimples under the finger spring protrusions—this is the position shown in FIG. 3. In the position shown in FIG. 3 one of the E-core channels is exposed and one wire of the wires 2A can be inserted in the channel. As more clearly shown in FIG. 15, the coupler housing adjacent the openings of the E-core channels has a necked wire holding aperture in the housing side wall so that the wire can be pushed into the-channel and gripped, when in the correct location, by the housing side walls. The necked aperture positively retains the wires 2A in the correct position in the E-core channels when the I-core is slid away from a respective E-core channel to expose/open that channel. With one wire correctly seated in the E-core channel as shown in FIG. 3, the I-core is then slid from its FIG. 3 position back through its central seated position shown in FIG. 2 into a third position shown in FIG. 4 in which the other of the E-core channels is opened allowing the second of the wires to be correctly seated in exactly the same way as in the other E-core channel and necked apertures of the coupler housing side walls. In the position shown in FIG. 4, the sprung finger protrusion sits in the third of the dimples on the upper surface of the I-core.

The I-core is then returned by sliding or wiping the I-core along the smooth mating surfaces of the E-core into its central position shown in FIG. 2. This is the operating position in which the coupler is used.

It will be appreciated that the coupler has three locking positions defined by the location of the dimples in the upper surface of the core 12. The dimples need not be located in the upper surface of the core but could be located in the side walls of the core to interact with parts of the panel housing. In this example, the dimples interact with a protrusion on the sprung finger 13. In other examples, the protrusions could be located on the upper surface of the I-core and could be moulded parts which are not of ferrite material and could engage with a similarly shaped co-operating dimple formed in the underside of the finger spring 13. The use of co-operating dimples and protrusions provides a position registration of the I-core with respect to the E-core in each of the three positions: a user position where the I-core is centrally mounted on top of the E-core; a first assembly position in which one E-core channel is exposed by sliding or wiping the I-core to one side; and a second assembly position in which the other E-core channel is exposed.

The use of a sliding motion between the I-core and the E-core is particularly advantageous over the use of a hinged two-part ferrite core or a clam-shell two-part ferrite core because dirt can collect on the mating spaces of the ferrite and an accumulation of dirt or particles on the mating surfaces of the ferrite will reduce efficiency. Clean faces of the ferrite can be maintained by using a sliding or wiping action such as achieved in the preferred embodiment of the present invention. The sliding or wiping movement of the I-core with respect to the E-core provides a cleaning action on the mating surfaces particularly during the installation process thereby improving the efficiency of the ferrite.

The overall size of the coupler, i.e. a footprint, is preferably in the region of 60 mm by 60 mm. Another example uses a coupler which is 70 mm in width (adopting the same convention used in FIG. 10), 66 mm in length L and 17.6 mm in thickness, excluding the universal clamp connectors. Examples of an embodiment of the coupler assembled and ready for use are shown in FIGS. 16-19.

Figure 20:
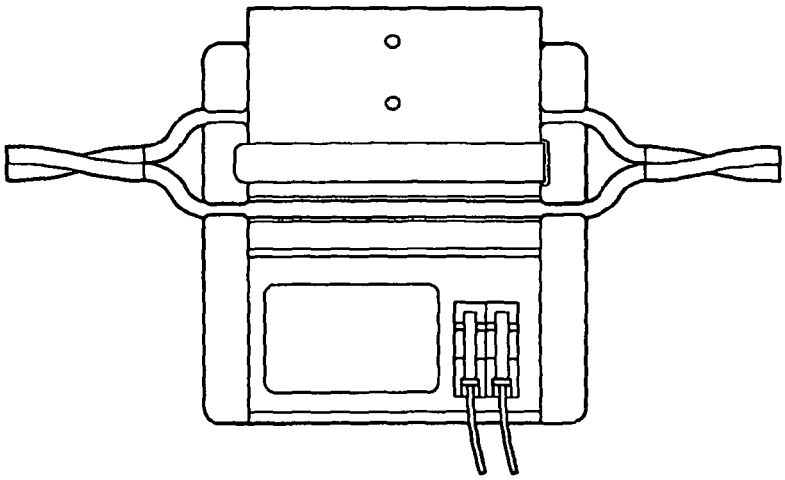
Figure 21:
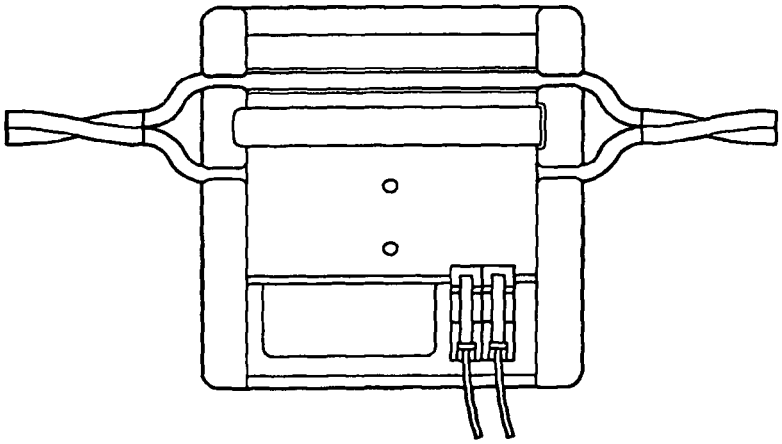

FIGS. 20 and 21 show the I-core slid to respective sides of the E-core to expose respective E-core channels with wires 2A correctly seated in their respective channels.

Figure 29:
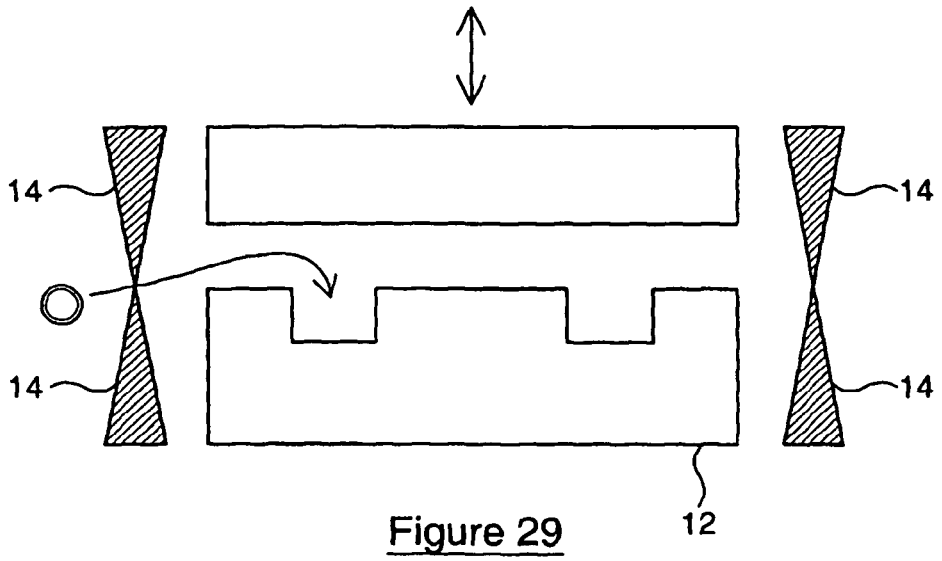

In the embodiments described above, the clamping mechanism is in the form of a sprung metal finger. However, in other embodiments, the clamping mechanism is arranged differently. In one embodiment, the clamping mechanism is a lever which is configured to raise and lower the top half of the ferrite core 12 relative to the bottom half of the ferrite core 12. In this embodiment, the two halves of the ferrite core 12 move apart from one another instead of one half sliding and remaining in contact with the other half. In this embodiment, the mating faces of the two halves of the ferrite core 12 are exposed when the level moves the top half away from the bottom half. In order to prevent the mating surfaces from becoming contaminated with dirt when they are not in contact with one another, this embodiment optionally incorporates a moveable barrier in the form of neoprene lips 14 that shield the edges of the ferrite core 12 but which allow the wires 2A to pass between the neoprene lips 14 so that the wires 2A can be positioned in the channels in the ferrite core 12. Such an embodiment is shown in FIG. 29. Other materials such as rubber or plastic may be used, provided they give a good wiping effect as a wire is pushed between them as shown in FIG. 29.

Figure 30:
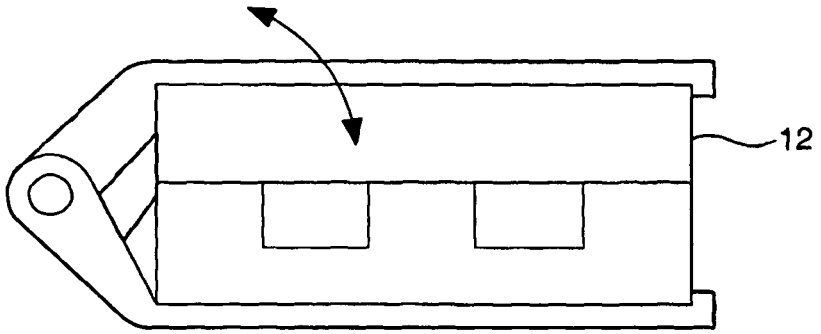

In a further embodiment, the two halves of the ferrite core 12 are pivotally attached to one another. In this embodiment, the ferrite core 12 is opened by pivoting the two halves relative to one another to allow the wires 2A to be positioned in the channels in the ferrite core 12. A cleaning device or product may be provided with this embodiment or with other embodiments of the invention to allow a user to clean the mating surfaces of the two halves of the ferrite core 12 to ensure optimal contact between the halves of the ferrite core 12. Such a particular embodiment with elements of a suitable mechanical arrangement is shown in FIG. 30.

Figure 23:
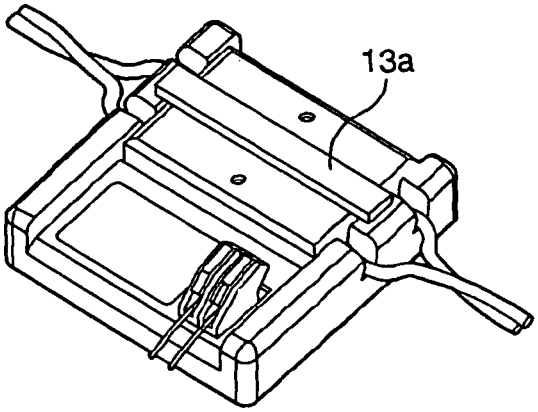
Figure 25:
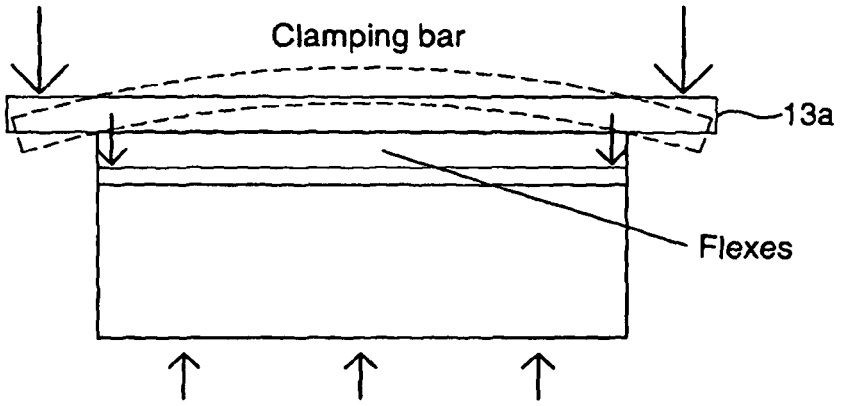

In a further preferred embodiment, the finger 13 is in the form of a bridge or clamping bar 13*a* as seen in FIGS. 23, 25 and 26, secured at both ends of its length. This enables a clamping force to be applied more evenly along the length of the I-core. It is required that the force required to clamp the two parts of the ferrite core together must fall within a suitable range that fulfils the following requirements: firstly, at the lower end, the clamping force must nonetheless be sufficient to reduce the occurrence of magnetostrictive noise; secondly, at the upper end, the clamping force must not be so great that the lateral force required to initiate sliding of the I-core over the E-core is beyond the power of the average human operator, when installing the coupler to a power distribution system in the manner herein described, or so great that any of the components of the coupler are damaged in use. The inventors have found that an upper limit to the clamping force of approximately 10 kg, for a core where the total area of the mating surfaces is about 1200 $mm^2$, is eminently suitable, being firm yet within the ability of the average human to operate. Where other mitigating techniques are applied, some of which are discussed below, the clamping force may be as low as 1 kg. In terms of pressure at the mating surfaces, the preferred range is in the region 10 to 100 kPa. Preferably the range is in the region 60 to 100 kPa. More preferably, the pressure is within the range 60 kPa to 80 kPa, or approximately 80 kPa.

Figure 24:
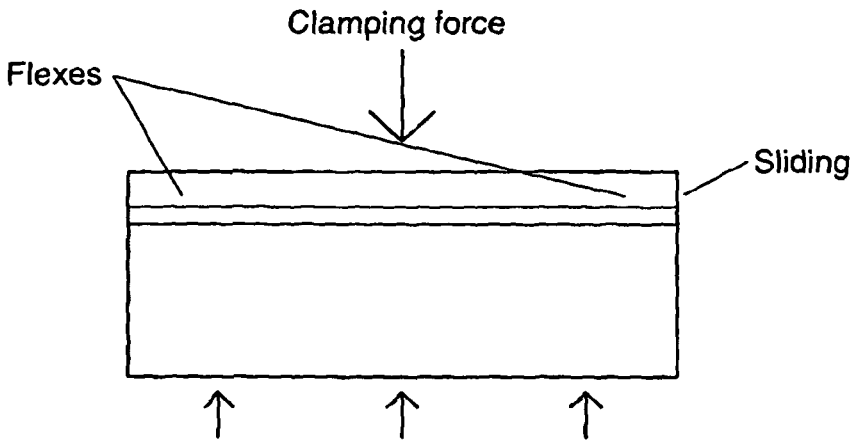
Figure 26A:
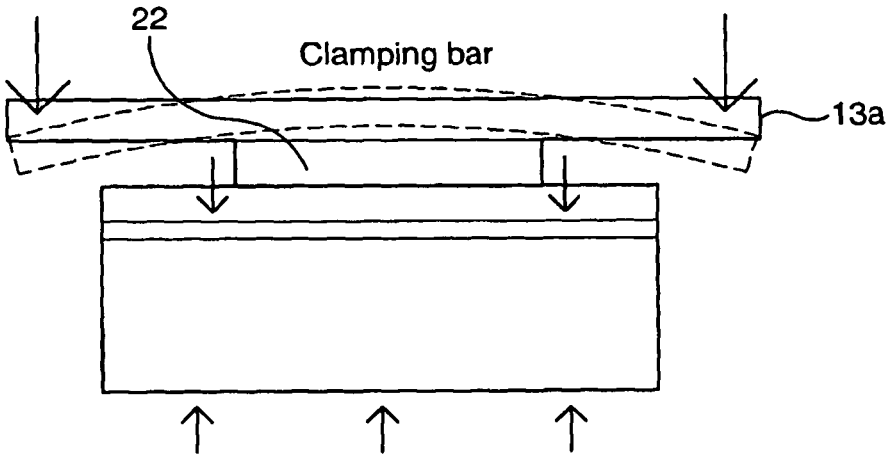
Figure 26B:
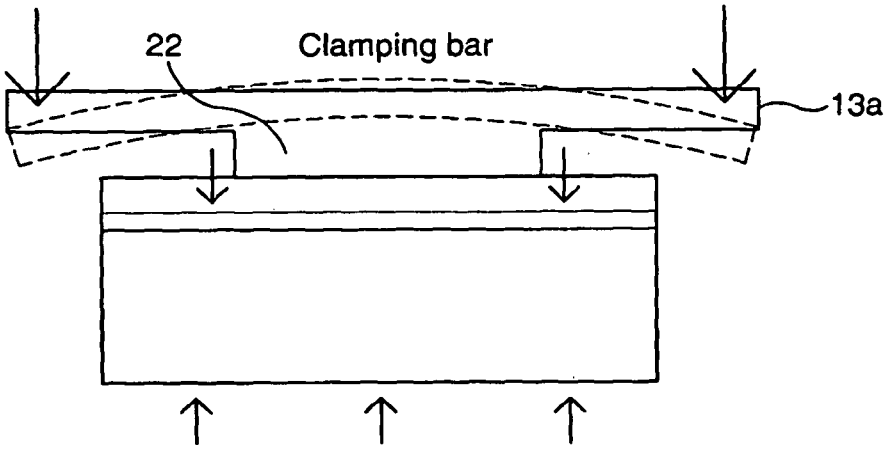
Figure 27:
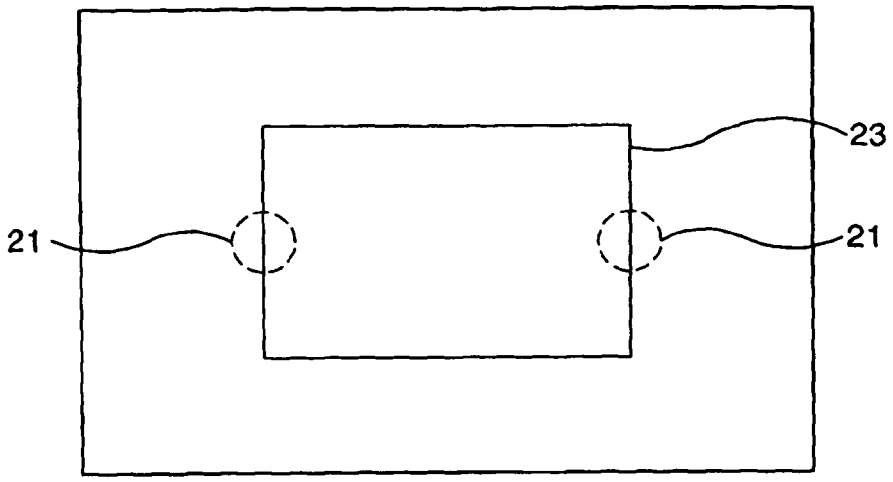

The ideal clamping method would be to have a force applied totally uniformly along the length of the I-core. This is however very difficult to realise. In one of the aforementioned embodiments, where the clamping pressure from the finger 13 or the clamping bar 13*a* applies its pressure largely at a single point in a dimple towards the centre of the length of the I-core, as seen in FIG. 24, vibration due to magnetostrictive force occurs at the ends of the I-core, which flex. FIG. 25 shows the embodiment where clamping bar 13*a* is in place. In practice, this tends to result in clamping at the ends of the I-core, and the centre part of the I-core tends to flex and vibrate, as shown. What is needed is an improved method of applying clamping force to the I-core from finger 13 or clamping bar 13*a*. Surprisingly, the inventors have found that there are two 'sweet spots' 21 as shown in FIG. 27 whereby, if the clamping force is concentrated at these points, it will very effectively minimise vibration for a given clamping force or pressure. These in turn are part of a larger 'sweet area' defined by the line 23 in FIG. 27. These sweet spots/sweet area 21/23 are generally located at the 25% and 75% lines of the ferrite dimensions. A preferential way of achieving this is shown in FIG. 26*a*, where a shim 22 is placed between the clamping bar and the I-core, with the edges of the shim at or overlapping the sweet spots 21/sweet area 23. An alternative embodiment is shown at FIG. 26*b*, where the 'shim' is an integral part of the clamping bar. A further alternative embodiment would be that the I-core is itself integral with the shim.

Figure 28:
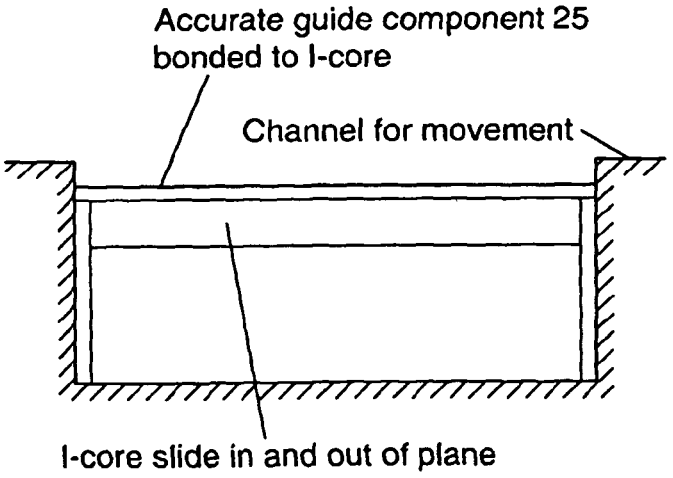

In a yet further preferential embodiment, the I-core has a guide component 25 bonded to its upper surface, as shown in FIG. 28. This guide component can fulfil multiple purposes. It can be or can comprise the shim element outlined above. Further, it can overhang or overlap the edges of the I-core and provide the sliding edges of the I-core within a channel provided to allow said sliding of the I-core. This has advantages where the edges of the channel may be made of a softer material such as plastic, and where the edges of the I-core may be sharp and can 'bite' into the channel edges upon the application of a torque to the I-core. Such a plastic guide component can slide with lower friction in the channel and simultaneously act to keep the I-core in desired spatial relationship with the E-core, i.e.: with the length orthogonal to the direction of slide, and the length of the I-core parallel to the length of the E-core. This is particularly useful where the ferrite core may have been manufactured by sintering of a pressed part, and where the tolerances of the finished ferrite parts may be relatively large due to the shrinkage of the parts during sintering, which shrinkage may commonly be in the region of up to 20%.

A further advantage of the guide component 25 is that the upper ferrite core piece to which it is attached may thus be arranged to have only one sliding surface—i.e.: that of the mating face. All other surfaces that require sliding may be part of the guide component. Accordingly, this minimises the chances of damage to the movable sliding I-core part of the ferrite core.

Further, the guide component 25 may be the item in which dimples or elongate channels as previously described are present, removing the requirement to form such features in the ferrite core itself and removing the possibility of a concomitant reduction in the efficiency of the core.

As noted elsewhere herein, it is preferred that the mating surfaces of the E-core/I-core combination are highly polished, preferably 'lapped', in order that they sit as closely together as possible in their mated configuration so as to improve the efficiency of the inductor. It increases inductance and helps to limit the production of magnetostrictive noise. One aspect of the invention is the wiping effect achieved by the way the I-core is slidable over the top of the E-core, which helps to maintain the cleanliness of the surfaces. Cleanliness of the mating surfaces is also important as any dirt on the surface interferes with the mating of the surfaces and again reduces efficiency.

The applicants have found that fingerprints on the mating surfaces present a particular and slightly surprising problem. Fingerprints comprise several substances, including lipids, oily triglycerldes and waxy esters of cholesterol and the like. These substances are generally not entirely removed even by the wiping action of the present invention. It has been found that when present on the smooth lapped surfaces, particularly at low ambient temperatures, waxes act as an adhesive on the lapped surfaces and this can present a particular problem as this acts to prevent the sliding mechanism that is a feature of the present invention.

It is known that the tapped surfaces themselves, whilst visibly 'smooth', tend to be not entirely smooth at the very small scale. A typical surface is perhaps 30% smooth at best, where smooth is defined as having undulations or pores of no more than 1 micron in depth. The remaining surface may comprise deep pores of up to or over 10 microns in depth.

It has surprisingly been found that an initial treatment of the lapped surfaces with tiny quantities of low viscosity silicone oil gives a lasting protection against the effects of fingerprints. The fingerprint waxes are prevented by the oil from adhering, and are readily removed by the wiping action of the sliding I-core. It is found that this effect persists even after a large number of wiping actions, and even after wiping of the surfaces with other materials such as cloth. It is, anticipated that a minute amount of the oil is retained by the deeper 'non smooth' pores of the surface even when wiping removes oil from the smooth parts of the surface. This minute amount of 'stored' oil then acts as a supply which results in an extremely thin film of oil being formed on the smooth surfaces during subsequent wiping actions.

Advantageously, it is found that magnetostrictive noise is also reduced by this treatment—gas tightness at the periphery of the mated surfaces is improved, enhancing atmospheric pressure for closing, and it adds viscosity between the faces. Even more surprisingly, the presence of the oil does not affect or diminish the efficiency of the core in acting as an inductor. The film thickness under pressure, along with the mild heating of the core when in operation, is sufficiently thin so as not to discernibly alter the effective inductance of the core assembly. Other oils with low viscosity and a wide temperature performance, such as medium chain alkanes, also produce these desirable effects. A PTFE or graphite treatment may also be used.

Figure 31A:
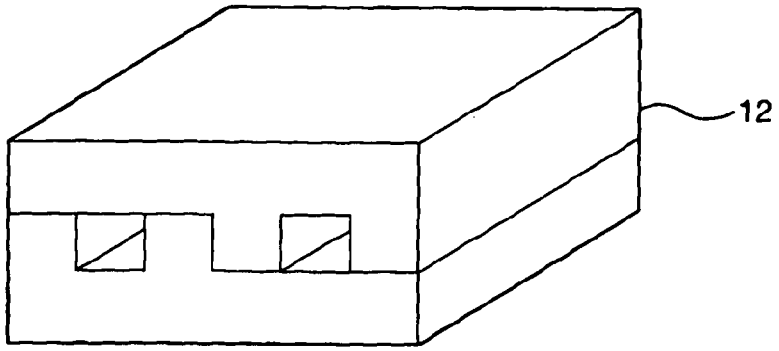
Figure 31B:
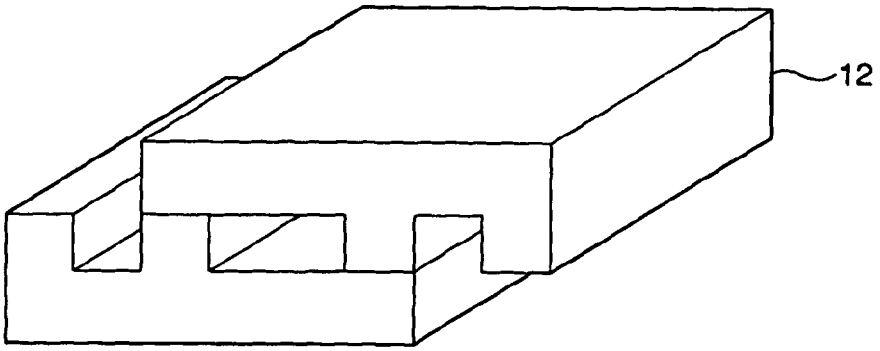

An alternative embodiment of the two-part ferrite core is shown in FIGS. 31*a* and 31*b*. It can be seen that this embodiment comprises what may be termed a pair of 'F'-cores. Advantages of this embodiment are that manufacture of the overall core only requires the manufacture of two off of the same part rather than manufacture of two different parts, with potential concomitant cost savings. Also, when the core is in an 'open' position (FIG. 31*b*), both wires of a twisted pair wire can be inserted in their respective slots in one operation, obviating the need for sliding an upper core element first one way and then the other way as described for other embodiments and potentially therefore simplifying the installation operation.

Figure 35:
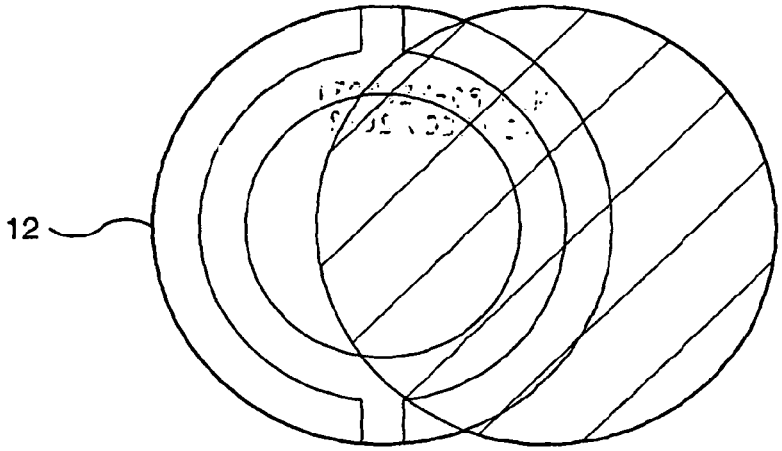

A further alternative embodiment of the two-part ferrite core is shown in FIG. 35. It may be termed an axi-symmetric core. This is particularly applicable when the core parts are totally separable as in FIG. 30.

Figure 36:
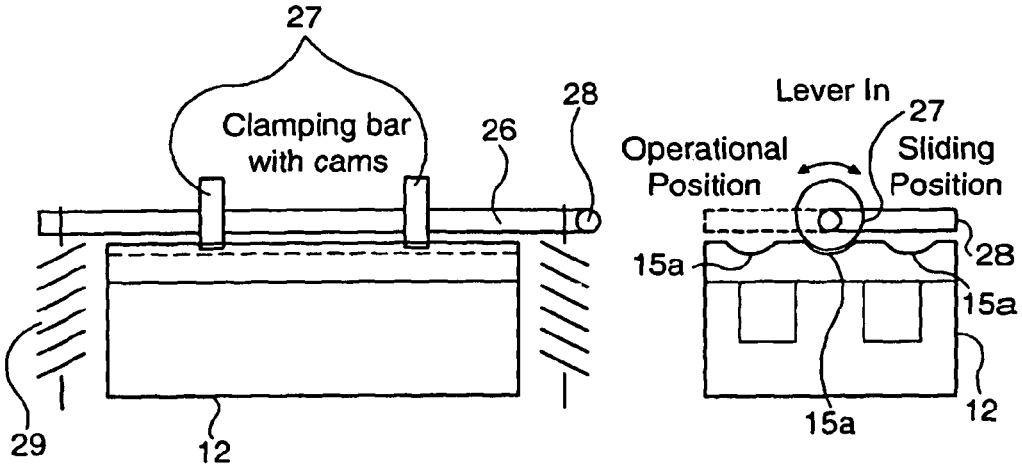

A further alternative clamping method is shown in FIG. 36. In this particular embodiment, a clamping bar 26 sits over the top of the ferrite core. The clamping bar has a lever 28 at at least one end to enable rotation of the bar and two eccentric cams 27 attached to it. Preferably, the two cams are positioned at the 'sweet spots' 21 previously mentioned, and within a channel or groove 15*a* in the upper surface of the I-core. With the lever in the operational position, the larger part of the cams sits beneath the clamping bar and presses down on the upper I-core ferrite core part. As the clamping bar is itself pulled downwards by spring means 29, this keeps the core parts together in a positive manner and with sufficient pressure to resist sliding of the I-core and minimise noise due to magnetostriction. With the lever in the sliding position, the smaller part of the cams presses down on the I-core, with less pressure. The I-core is then more susceptible to sliding pressure, although it moves into particular engagement positions due to the presence of further grooves or channels in the upper surface of the I-core which advantageously define the preferred limits of movement of the I-core. This offers the advantage of a variable pressure on the ferrite core which is greater when the ferrite core is in use as a transformer and lesser when the system is 'off' and installation or de-installation is desired, and when lesser pressure is advantageous to allow the user to slide the upper ferrite core, whilst still retaining some pressure so as to positively retain the ferrite core within a coupler and allow the 'wiping' motion to have adequate cleaning effect of the mating surfaces.

When used in this specification and claims, the terms "comprises" and "comprising" and variations thereof mean that the specified features, steps or integers are included. The terms are not to be interpreted to exclude the presence of other features, steps or components.

What is claimed is:

1. A coupler comprising a core, the core comprising one part and another part, wherein the one part is slideable with respect to the other part in one direction through a central position to open at least one channel and in another direction back through the central position to open at least one other channel and wherein the coupler is configured to continuously urge the parts together to remain in contact with one another during the said sliding of the parts with respect to one another, wherein the said directions are substantially perpendicular to the said channels.

2. The coupler according to claim 1, wherein, the one part is slideable with respect to the other part to:

at least one relative position where the one channel is open and the other channel is closed;

at least one relative position where the one channel is closed and the other channel is open; and at least one relative position where both the one channel and the other channel is closed.

3. The coupler according to claim 1, wherein the one part is slideable with respect to the other part to open the one channel to enable a length of conductor to be laid in the one channel and to open the other channel to enable another length of conductor to be laid in the other channel, wherein the one part is slideable with respect to the other part to close both the one channel and the other channel to enclose the length of conductor in the one channel such that the length of conductor is threaded through the channel and to enclose the other length of conductor in the other channel such that the other length of conductor is threaded through the other channel.

* * * * *